US008572768B2

(12) United States Patent
DeWitt et al.

(10) Patent No.: US 8,572,768 B2
(45) Date of Patent: Nov. 5, 2013

(54) URINAL SEAL AND METHOD OF INSTALLATION

(75) Inventors: Donald James DeWitt, Davison, MI (US); Anthony John Dipzinski, Grand Blanc, MI (US)

(73) Assignee: Fernco, Inc., Davison, MI (US)

( * ) Notice: Subject to any disclaimer, the term of this patent is extended or adjusted under 35 U.S.C. 154(b) by 861 days.

(21) Appl. No.: 12/683,331

(22) Filed: Jan. 6, 2010

(65) Prior Publication Data

US 2011/0162133 A1 Jul. 7, 2011

(51) Int. Cl.
*E03D 11/17* (2006.01)

(52) U.S. Cl.
USPC ..... 4/252.6

(58) Field of Classification Search
USPC ..... 4/252.1, 252.5, 252.6, 311, 301
See application file for complete search history.

(56) References Cited

U.S. PATENT DOCUMENTS

| | | | | |
|---|---|---|---|---|
| 3,400,411 | A * | 9/1968 | Harvey | 4/252.6 |
| 7,069,603 | B2 * | 7/2006 | Flushing | 4/252.1 |
| 2003/0033662 | A1 * | 2/2003 | Spells et al. | 4/252.5 |

* cited by examiner

*Primary Examiner* — Huyen Le
(74) *Attorney, Agent, or Firm* — Dickinson Wright PLLC

(57) ABSTRACT

A urinal seal and a method of installing a urinal with a urinal seal located between the siphon outlet on a urinal and the plumbing drain lines of a building structure. The urinal seal generally includes a pipe insert portion and seal portion radially extending outwardly therefrom. The seal portion includes a first surface having an applied adhesive and a second opposing surface having a circumferential flange extending therefrom.

21 Claims, 9 Drawing Sheets

URINAL SEAL AND METHOD OF INSTALLATION

CROSS-REFERENCE TO RELATED APPLICATIONS

This patent application is related to Design Patent Application Ser. Nos 29/353,286, 29/353,290, 29/353,294 and 29/353,297 which are filed on even date herewith.

BACKGROUND OF THE INVENTION

1. Field of the Invention

The present invention is directed to a method of installing a urinal on a vertical wall as well as to a urinal seal located between a siphon outlet on the urinal and the plumbing drain lines of a building structure.

2. Discussion

Urinals are common fixtures in public restrooms with many public restrooms including multiple urinals. While the style and design of urinals may vary and has changed over the years, including the recent development of flushless or waterless urinals, the method of installation of urinals on vertical walls as well as the types of seals used has changed little. Many plumbers find installing a urinal to be a difficult and frustrating task, whether as a new installation, a replacement or a repair.

One problem with installing urinals is that unlike toilets, the water supply lines and drain lines pass through a vertical wall. This vertical wall makes it difficult to position install the urinal in particular ensuring a water tight seal between the urinal and the drain lines. As illustrated in the Figures, a urinal seal is located out of sight and out of reach during installation. The urinal mounting brackets from which the urinal is hung must be placed very accurately relative to the drain line. Any deviation in the positioning of the brackets relative to the drain lines may cause leaks from improper alignment or sealing of the seal. In addition, many plumbers find it difficult to properly engage and maintain the seal between the siphon outlet on the urinal and the drain lines in the building's structure in position on the vertical wall while the urinal is installed. Unlike toilets and toilet seals, gravity works against maintaining the seal in the proper position.

Therefore, it is desirable to develop a new method of installation and a new urinal seal that allows for improved installation accuracy, shortened installation times and fewer leaks than what is currently on the market.

SUMMARY OF THE INVENTION

The present invention is directed to a method of installing a urinal on a vertical wall as well as to a urinal seal located between a siphon outlet on the urinal and the plumbing drain lines of a building structure.

The urinal seal includes a pipe insert portion having a frusto-conical shape; a seal portion radially extending outward from the pipe insert portion; a circumferential flange extending from the seal portion and substantially uniformly spaced from the pipe insert portion; a sealant applied to the sealing portion and wherein the adhesive is applied to the opposing side of the seal portion from the circumferential flange; and a circumferential adapter sealing surface located between the pipe insert portion and the circumferential flange.

The pipe insert portion includes a wall extending from the seal portion to an end and wherein the end has a thickness that may be tapered to a thinner thickness from the portion proximate to the seal portion, but may also have a substantially uniform thickness. In some instances, the walls include a first portion having a substantially uniform thickness and a second portion having a reducing thickness from the first portion to the end.

The urinal seal may also include a circumferential flange having various shapes, such as a triangular shaped cross-section, a rounded cross-section shape, or a rectangular cross-sectional shape.

The sealing portion includes a first surface and a second surface substantially parallel to the first surface and an adhesive is adhered to the first surface and the second surface is the adapter sealing surface.

The urinal seal may also include a pipe insert portion having a frusto-conical shape and wherein the pipe insert portion is approximately equal to or less than two inches at its widest outer diameter; a seal portion radially extending circumferentially outwardly form the pipe insert portion and proximate to the widest outer diameter of the pipe insert portion and wherein the seal portion includes a first surface opposed to an adapter sealing surface; and a sealant adhered to the sealing portion and wherein the tacky material is adhered to the first surface.

The method of installing a urinal on a vertical wall, generally includes the steps of providing a urinal seal having a pipe insert portion and a flange extending radially outward from the pipe insert portion; inserting the urinal seal partially into the drain inlet until the pipe insert portion sealingly engages the inner drain surface; mounting the urinal to the vertical wall with the siphon outlet engaging the flange of the urinal seal; and fastening the urinal to the wall to compress the flange between the siphon outlet and the drain inlet.

The step of fastening may include the step of compressing the flange between the siphon outlet and the wall adapter.

The method of mounting the urinal may further include the steps of mounting an upper portion of the urinal to the vertical wall; and tilting a lower portion of the urinal in an arcuate motion toward the vertical wall until the siphon outlet engages the radial flange of the urinal seal.

BRIEF DESCRIPTION OF THE DRAWINGS

Other advantages of the present invention will be readily appreciated and more fully understood by reference to the following detailed description when considered in connection with the accompanying drawing wherein.

DETAILED DESCRIPTION OF THE INVENTION

Figure 1:
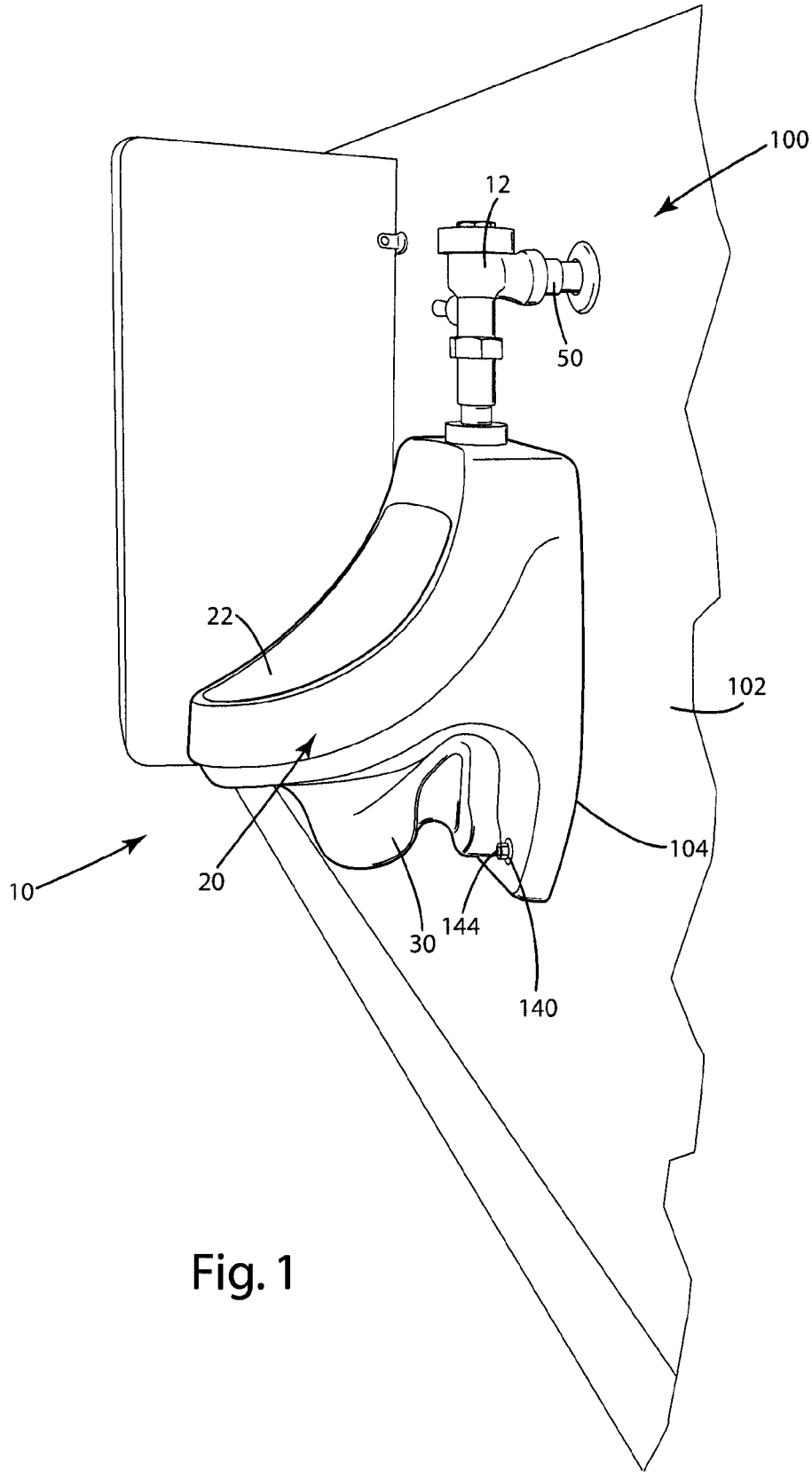
FIG. 1 is a perspective view of a restroom with a urinal coupled to the wall.

The present invention is generally directed to a method of installing a urinal assembly 10 and also to a urinal seal 60 that is positioned after installation of the urinal assembly 10 between a urinal 20 and drain lines 120 of a structure 100. As illustrated in FIG. 1, the urinal assembly 10 generally includes a flushometer 12 which meters and provides the supply of water and a urinal 20 typically formed from a porcelain material. The urinal 20 generally further includes a bowl 22 and a siphon 30 extending from the bowl. The urinal 20 is configured to be mounted to a building structure 100 such as the illustrated vertical walls 102 including a mounting surface 104. The urinal assembly 10 may be configured to have any desired size, shape, style or configuration.

Figure 2:
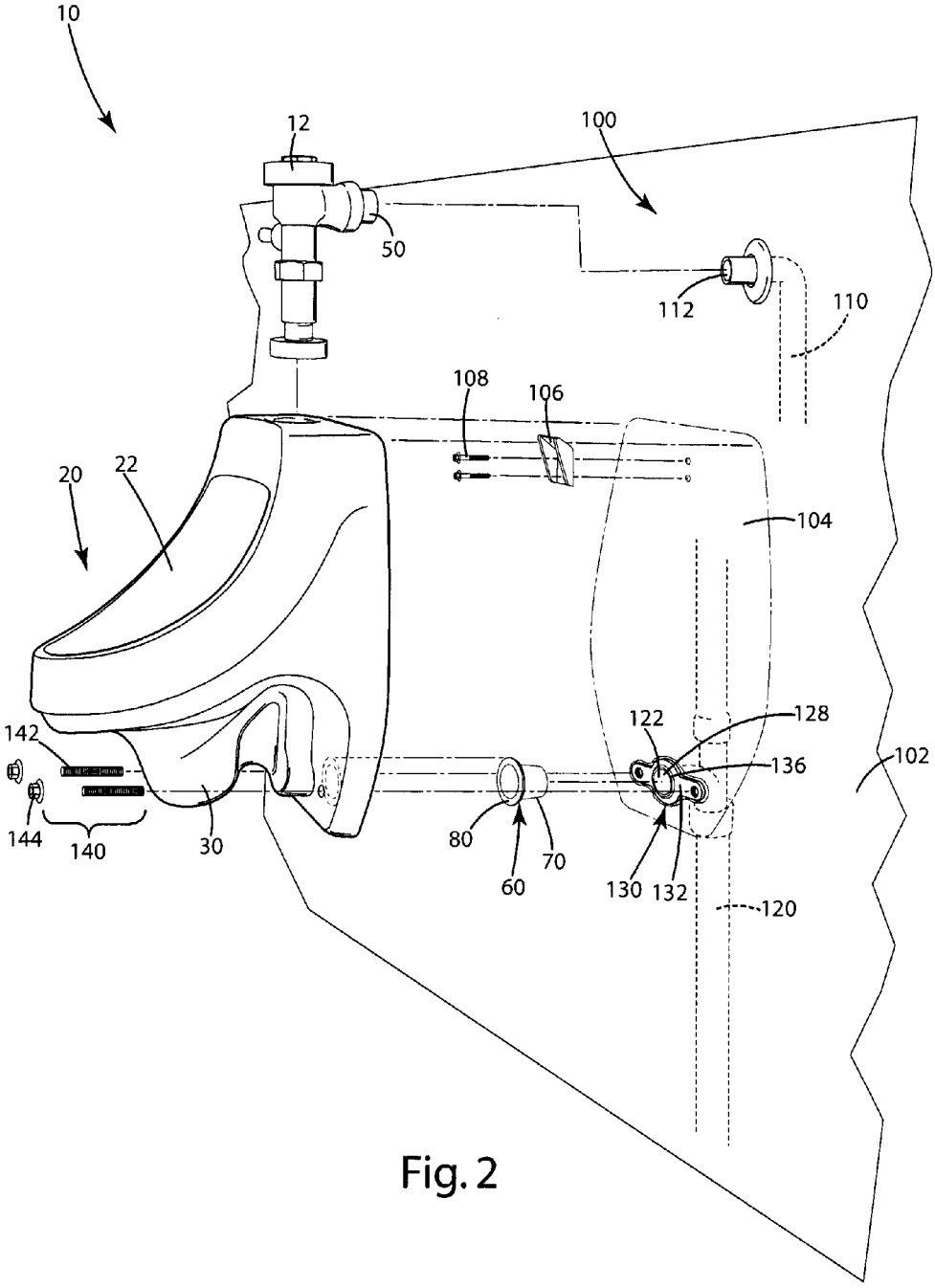
FIG. 2 is an exploded view of the urinal assembly in FIG. 1.
Figure 3:
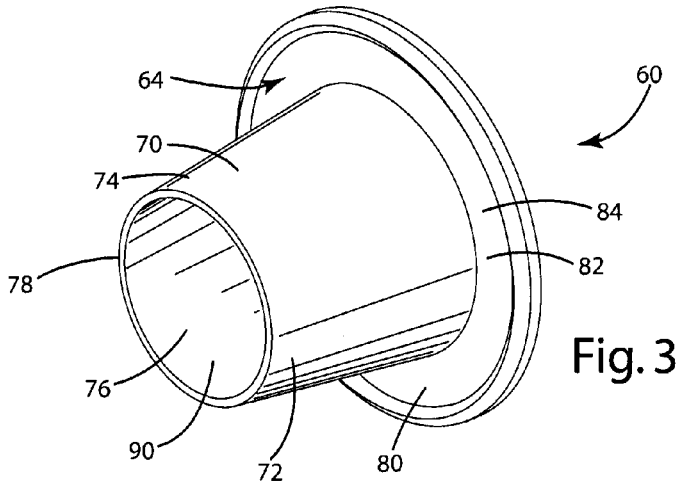
FIG. 3 is a rear perspective view of the urinal seal.
Figure 4:
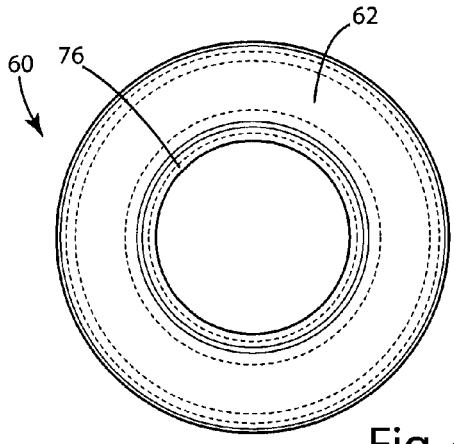
FIG. 4 is a top view of the urinal seal.
Figure 5:
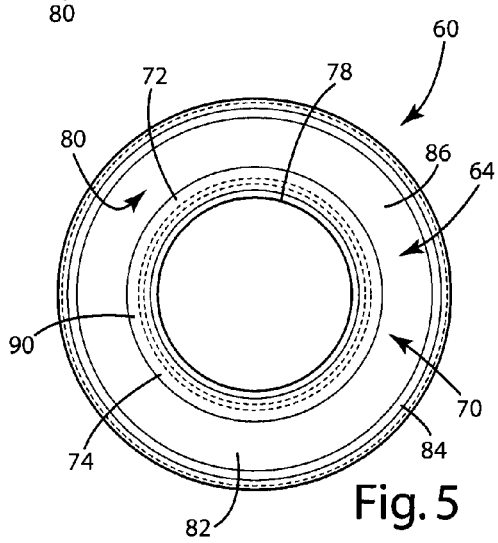
FIG. 5 is a rear view of the urinal seal.
Figure 6:
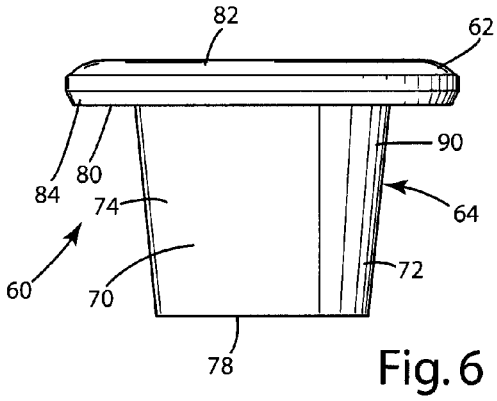
FIG. 6 is a side view of the urinal seal.

As illustrated in FIG. 2, the urinal assembly 10 is shown in an exploded perspective view with phantom lines illustrating the location of the installed position of the urinal 20 on the wall 102 and hidden lines showing the pipes within the wall 102. As further illustrated in FIG. 2, the urinal assembly 10 in addition to the flushometer 12 and urinal 20 generally includes a water inlet 50, a urinal seal 60, a mounting bracket 106 and mounting fasteners 108. The urinal assembly 20 is also illustrated as including a wall adapter 130, but in some embodiments this may be solely incorporated (not illustrated) into the drain lines 120. An adapter fastener assembly 140 may also be included to fasten the lower portion of the urinal to the wall 102. Of course, other than the urinal seal 60 as further described below in detail, the size, shape, style and configuration of each individual part of the urinal assembly 10 may vary as desired, and the illustrated portions are only exemplary.

The urinal seal 60 generally includes a seal body 64, a sealing material 62 such as an adhesive which is more clearly shown in the cross-sectional configuration in FIGS. 7-13 and FIGS. 19-22. The urinal seal 60 is generally configured to fit at least partially within the drain lines and, if included, into the wall adapter plate 130 as illustrated in FIG. 14 to create a seal between the urinal seal and the inner surface 128 of at least one of the drain lines 120 and wall adapter 130. The urinal seal also creates a seal with the siphon 30.

The urinal seal body 64 is generally formed from a rubber compound such as a gasket material and more specifically, a plasticized PVC compound with a Shore A durometer hardness of approximately 75. Other useful compounds that could be useful in forming the seal body 64 are thermoset elastomers and or thermoplastic elastomers conforming to the requirements of ASTM A 1045. The sealing material 62 is applied to the seal body 64 and is generally tacky such that it is shipped with a non-stick paper covering. The sealing material 62 is generally formed from a hot applied pressure sensitive adhesive. Of course, adhesives that are compatible with the gasket material and sewer drain, waste and vent systems may be used. Generally, the adhesive is configured to provide a seal between the urinal 20 and the urinal seal 60.

The seal body 64 generally includes a frusto-conical shaped pipe insert portion 70 with a seal portion 80 extending radially outwardly therefrom. The sealant 62 is generally applied to a surface of the seal portion 80. The frusto-conical shaped pipe insert portion 70 generally includes walls 74 having an outer surface 72 and an inner surface 76 terminating on one side at an end 78 and on the other side at the seal portion 80. The frusto-conical shaped pipe insert portion 70 is configured to fit within the drain lines 120 and in particular be sealingly engaged against at least one of a wall adapter 130 and drain lines 130. The frusto-conical shaped pipe insert portion 70 generally has diameter of the outer surface 72 proximate to the seal portion 80 of approximately equal to two inches and a diameter of the outer surface 72 proximate to the end 78 of approximately equal to or less than 1.875 inches and more preferably less than or equal to 1.75 inches. These outer diameters are configured to allow easy inserting and sealing to wall adapters 130 formed both from brass and PVC and to drain lines 120, allowing for variations in the drain inner diameter 126 of the drain lines 120 and the inner diameter of the wall adapter 130. As illustrated in the Figures, the outer surface 72 generally has a smooth outer surface extending from the seal portion 80 to the end 78.

Figure 7:
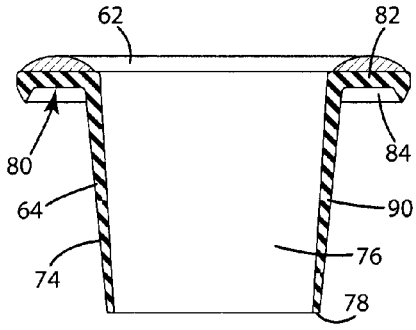
FIG. 7 is a cross-sectional view of the urinal seal having tapered walls and a triangular outer flange.
Figure 8:
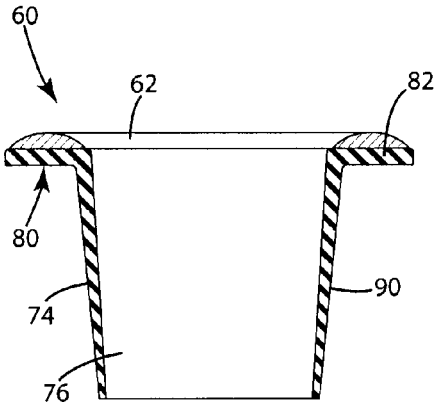
FIG. 8 is a cross-sectional view of the urinal seal having tapered walls and no outer flange.
Figure 9:
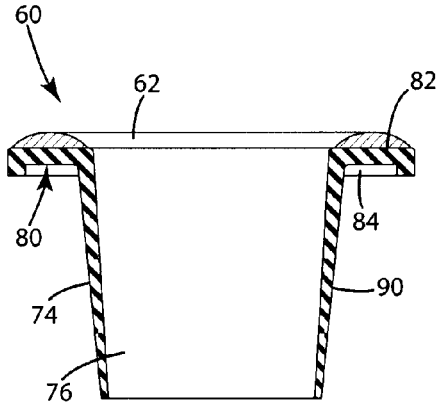
FIG. 9 is a cross-sectional view of a urinal seal having tapered walls and a rectangular outer flange.
Figure 10:
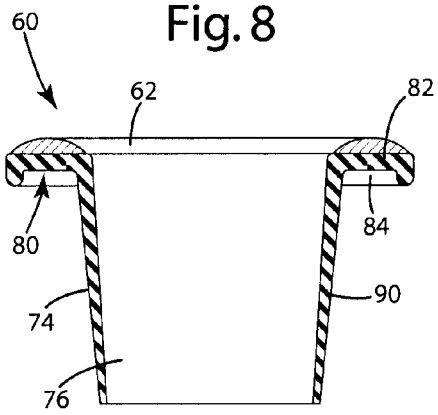
FIG. 10 is a cross-sectional view of a urinal seal having tapered walls and a rounded outer flange.
Figure 11:
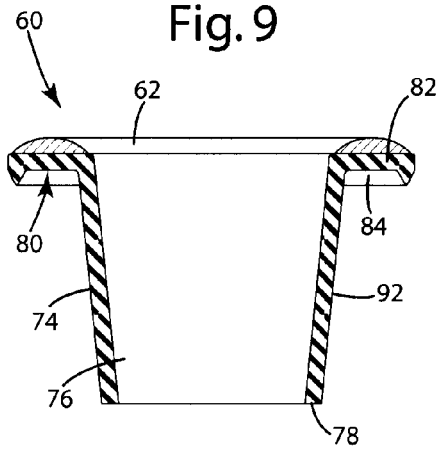
FIG. 11 is a cross-sectional view of a urinal seal having walls without tapered thickness and a triangular outer flange.
Figure 12:
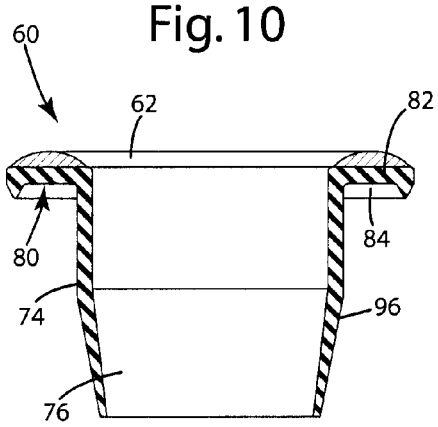
FIG. 12 is a cross-sectional view of a urinal seal having walls that taper proximate to a mid-point and a triangular outer flange.
Figure 13:
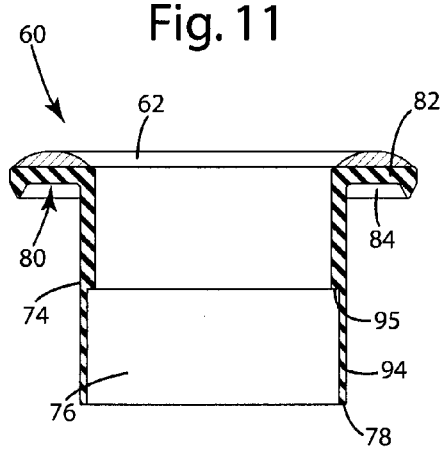
FIG. 13 is a cross-sectional view of a urinal seal having reduced thickness walls and a triangular outer flange.
Figure 14:
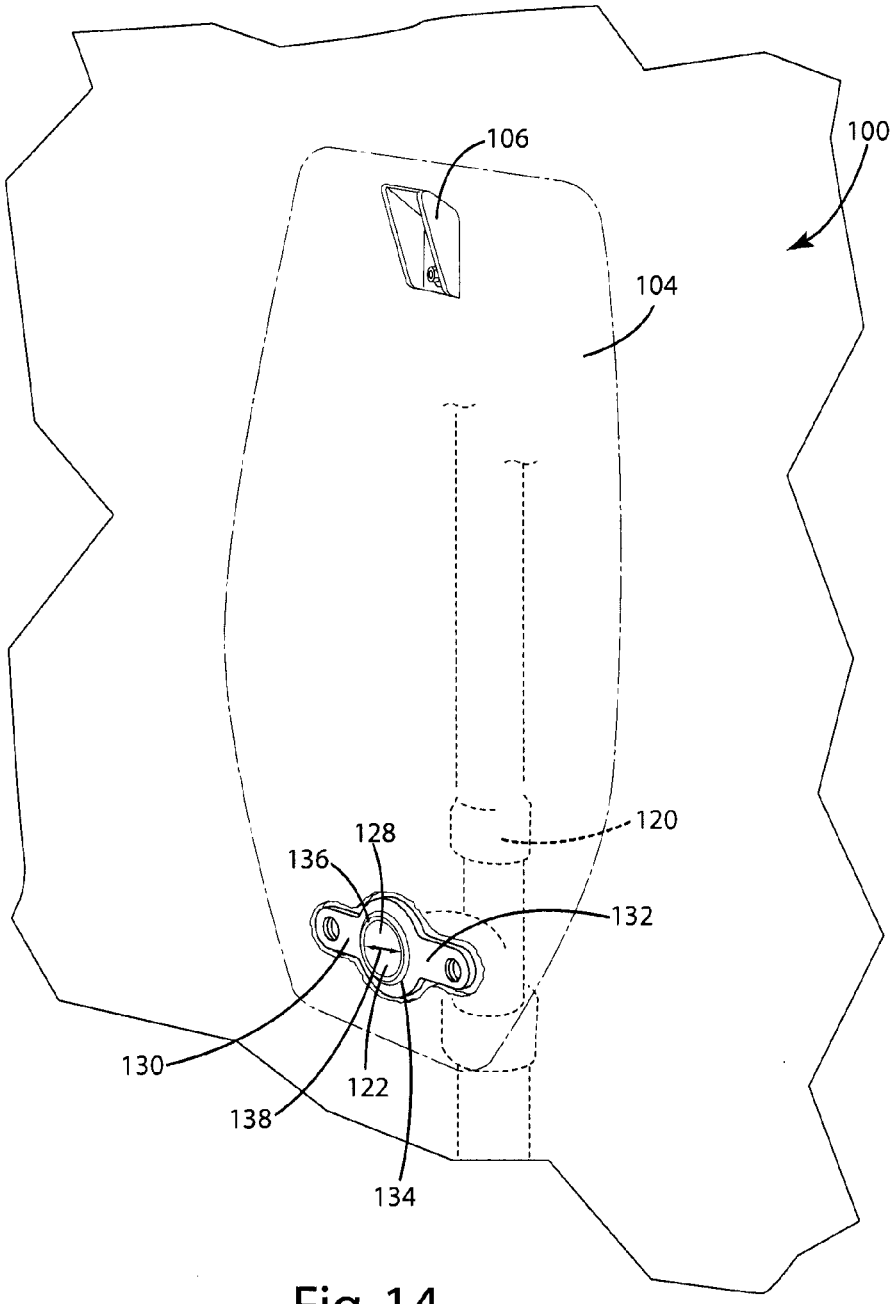
FIG. 14 is an enlarged perspective view of the mounting area of the urinal seal including hidden lines illustrating pipes within the wall.
Figure 15:
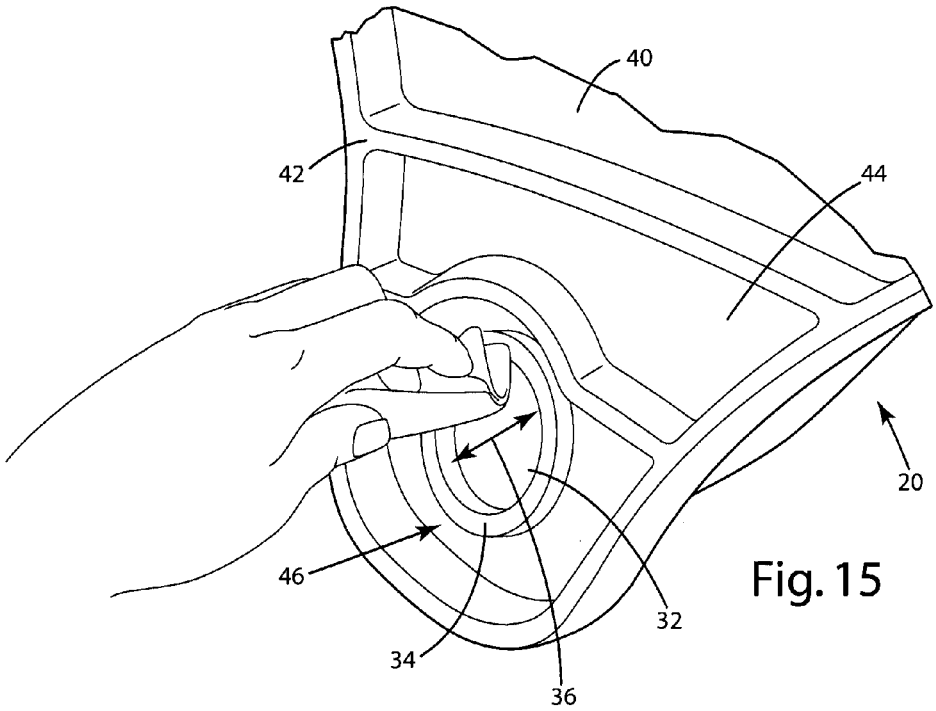
FIG. 15 is a partial perspective view of the wall side of the urinal.

The frusto-conical shaped pipe insert portion 70 may have slight variations in the configurations of the wall 74 as illustrated in the tapered thickness of the wall 74 in FIGS. 7-9 compared against the non-tapered thickness of the wall in FIG. 11 as well as the mid-point to end 78 tapered thickness wall 74 in FIG. 12 and further the midpoint reduced thickness wall 74 in FIG. 13. The tapered walls in FIGS. 7-10 are generally configured to allow increased flexibility near the end 78 as compared to the walls 74 proximate to the seal portion 80. The thicker wall 74 proximate to the sealing portion 80 ensures a watertight seal with the inner surface of the drain lines and/or wall adapter. More specifically, this configuration allows for easier insertion into the wall adapter 130, improved retention in place as the urinal 20 is installed, and a stiffer more water tight seal between the urinal seal and at least one of the wall adapter 130 and the drain lines 120. More specifically, the largest diameter portion of the pipe insert portion is configured to be in a water tight sealing engagement when the urinal seal is fully installed into the drain lines 120. FIGS. 11-13 illustrate various other wall configurations found to be an acceptable balance between ease of insertion and ensuring a water tight seal.

Figure 22:
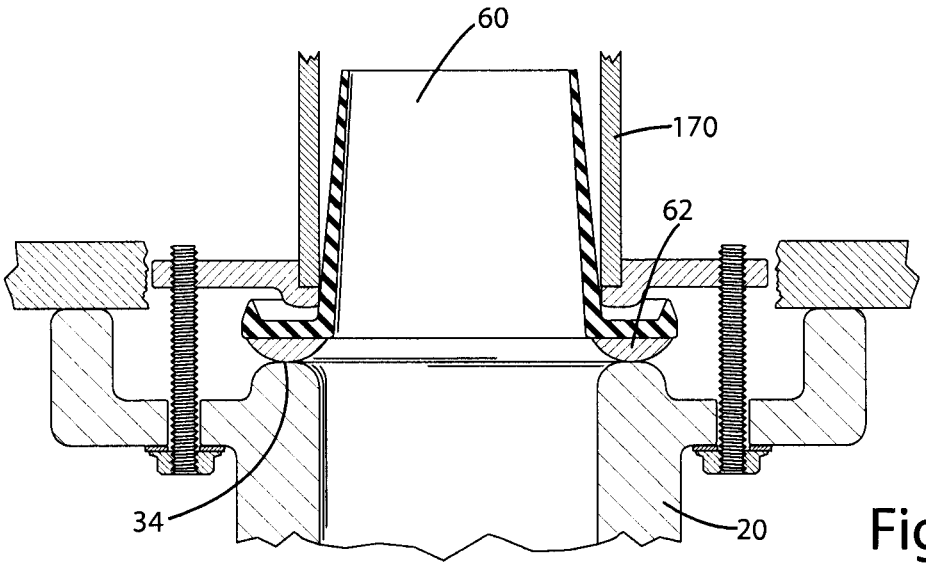
FIG. 22 is a cross-sectional view of the wall and urinal illustrating a final installed position of the urinal seal and urinal relative to the wall adapter.

The seal portion 80 extends radially outward in a circumferential fashion from the frusto-conical shaped pipe insert portion 70. The seal portion 80 specifically includes an outwardly extending flange or lip 82 and a circumferential flange 84 near the outer diameter of the seal portion 80 that extends in approximately the same direction as the pipe insert portion 70 form the seal portion 80. As illustrated in FIG. 8, the seal portion 80 may be formed without the circumferential flange 84. As further illustrated in FIGS. 7, 9 and 10, the circumferential flange may be a triangle, a square or a rounded ledge. Of all these circumferential flanges, it has been found that the triangular shaped outward circumferential flange 84 illustrated in FIG. 7 provides a good balance of ease of manufacturing as well as an enhanced seal against the wall adapter 130, particularly an adapter plate 132 and more particularly an adaptor sealing surface 134, on the wall adapter 130. The outwardly extending flange 82 further includes an adapter sealing surface 86 configured to be engaged against an adapter sealing flange 136 extending from the wall adapter 130 and when combined with the circumferential flange 84 creates a double seal for water tightness. This is in addition to the seal created between the outer surface 72 of the walls of the frusto-conical shaped pipe insert portion 70 and the inner surface of the wall adapter 130 and drain lines 120. Therefore, the urinal seal creates at least three independent sealing zones between the urinal seal and the structure 100 in which the urinal 20 is installed, specifically two with the wall adapter 130 and one with at least one of the drain lines 120 and wall adapter 130. When combined with the seal created between the urinal 20 and the urinal seal 60, for a total of at least four sealing zones. However, as illustrated in FIG. 22, the urinal seal may be configured to only seal with two sealing zones, specifically that of the frusto-conical pipe insert portion and the drain line, as well as the adhesive to the urinal. Therefore, if the wall plate adapter is not located flush with or extending proud of the wall or is improperly installed, the urinal seal may still provide a seal between the urinal and drain line.

The present invention is also directed to a method of installing a urinal. In a new urinal installation, the plumber will first run the drain lines 120 and in particular extend a drain inlet 122, having a drain inner diameter 126, out of or approximately flush with the surface of the walls 102 and in particularly extend out of or flush with the mounting surface 104 of the walls 102. In addition, if required, the plumber will also run water supply lines 110 including a water supply outlet 120 configured to be coupled to the flushometer 12 of the urinal assembly 10. While some variation may exist regarding the location of these water supply lines 110 and drain lines 120, they typically require accurate location relative to each other and specifically configured relative to the particular urinal to be installed. Of course, in existing installations where repair was needed or the urinal is simply being replaced with a newer model, these drain lines 120 or water inlet lines 110 may already exist and not need to be run by the plumber. In addition, for the installation of some waterless urinals which are increasingly becoming more common, the plumber would not need to run water supply lines 110. As illustrated in FIG. 2 and further in FIG. 14, with the supply lines 110 and drain lines 120 installed, the plumber may mount a wall adapter 130 onto the drain lines 120. A cross-sectional view of the wall adapter 130 and drain lines 120 relative to the wall 102 may be illustrated further in FIGS. 19-21. Of course, in existing installations, the wall adapter 130 may already be installed, and some embodiments may not use a wall adapter. If the wall adapter 130 is already installed, the plumber would clean the surface of the wall adapter 130 specifically the adapter sealing surface 134 and inner surface 128 to minimize any potential problems with sealing caused by existing dirt and grime.

As part of the installation process of a new installation, the plumber would also mount on the walls 102 a mounting bracket 106. The mounting bracket 106 is generally mounted with mounting fasteners 108. The mounting bracket 106 illustrated in FIG. 14 is only an exemplar mounting bracket which may vary in size, shape, configuration and design depending upon the style, design or manufacturer of the urinal 20 being installed. In addition, the Figures only illustrate one mounting bracket 106; however, multiple mounting brackets may also be used. The position of the mounting bracket 106 upon the walls 102 is generally dependent upon the design of the urinal and is typically specified by the manufacturer of the urinal and the accuracy of the position relative to the inlet of the drain lines is important. As clearly illustrated in FIG. 14, the phantom lines show the mounting surface 104 of the urinal upon the walls 102. With the wall adapter 130, mounting brackets 106 and if needed, water supply lines 110 installed upon the walls, the steps of preparation of the walls or building structure are generally completed.

Figure 16:
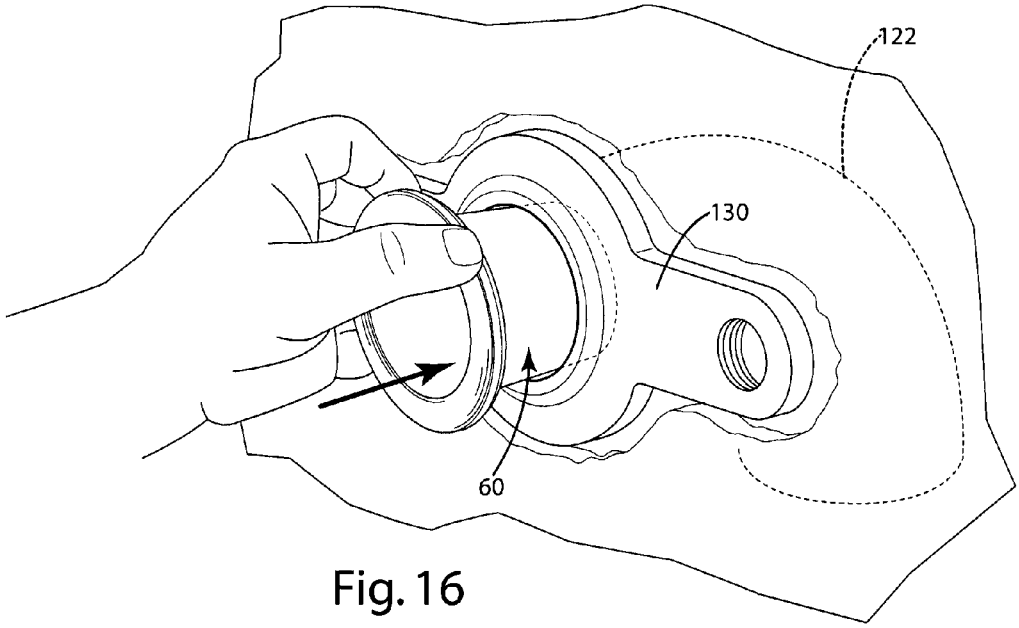
FIG. 16 is a partial front perspective view of the wall showing insertion of the seal into the drain pipes and wall adapter.
Figure 17:
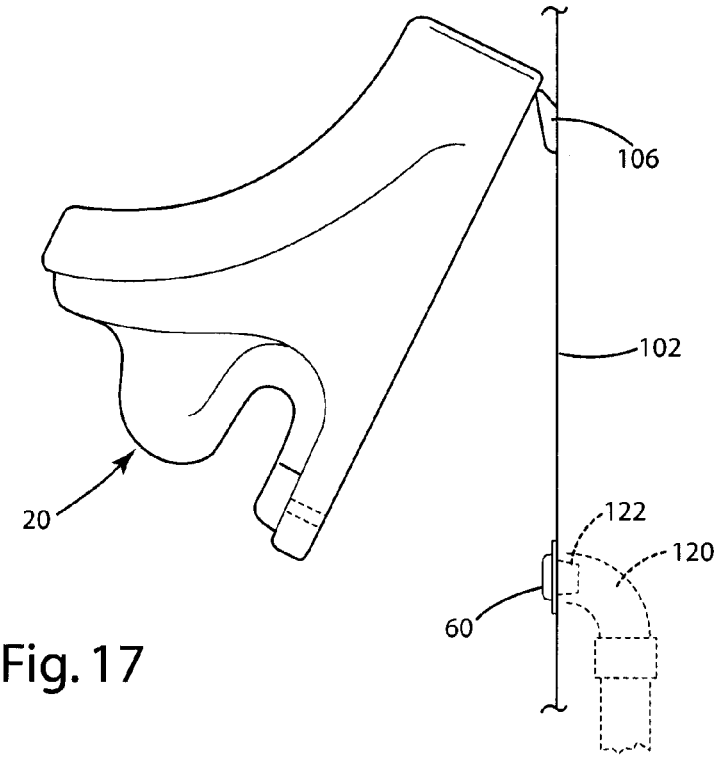
FIG. 17 illustrates a side view of the initial hanging of the urinal.
Figure 18:
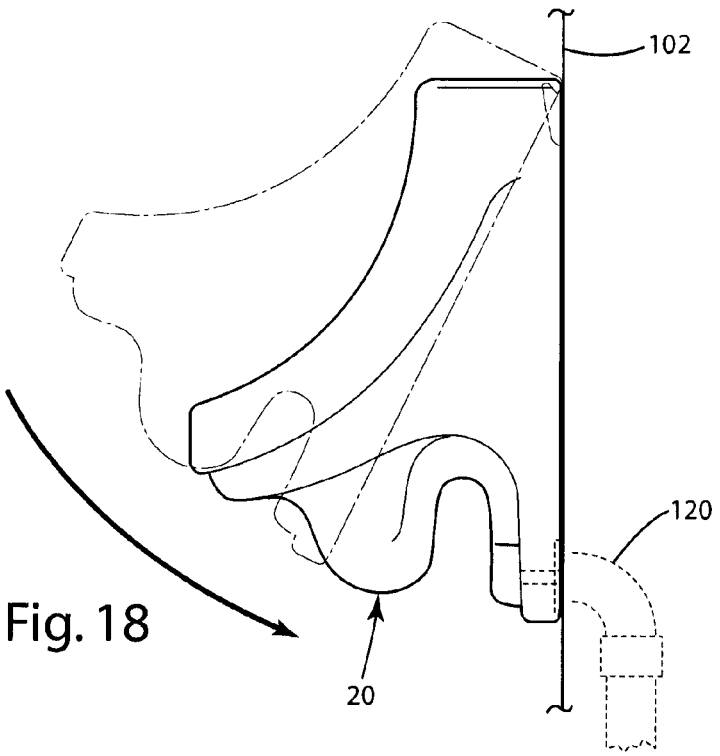
FIG. 18 illustrates a side view showing the urinal being swung into place with dashed lines showing the starting position and solid lines showing the end position.
Figure 19:
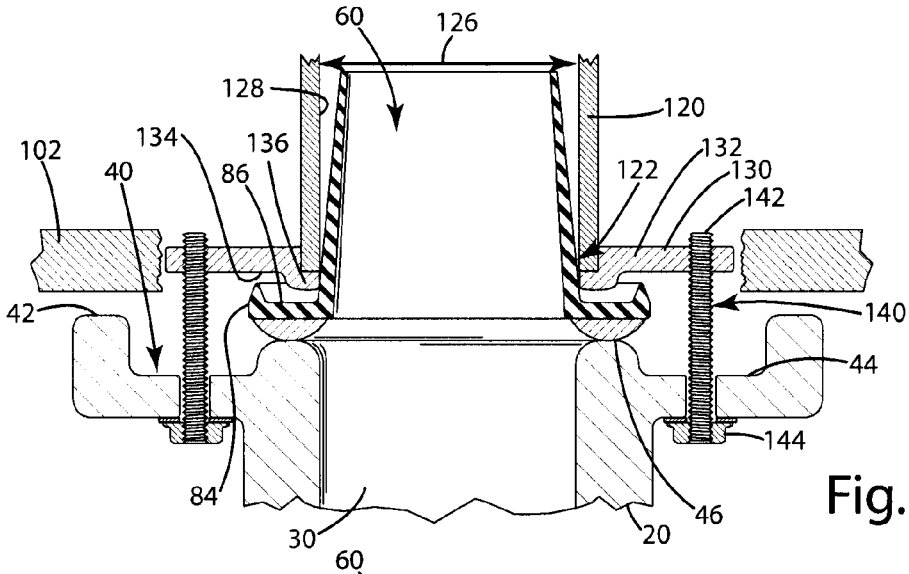
FIG. 19 illustrates the cross-sectional view of the urinal and wall illustrating first contact.

The plumber would then insert the seal 60 into the wall adapter 130 and more particularly into the drain inlet 122. The plumber would insert the seal 60 with the reduced diameter portion of the end 78 first until the frusto-conical shaped pipe insert portion 70 is substantially and completely installed into and engaging the drain inlet 122 formed by the drain lines 120 and if present, also by the wall adapter 130 as illustrated in FIG. 19 as well as the insertion being shown in FIG. 16. If the seal 60 includes a sealant 62 such as an adhesive applied to the seal body 64, it may be desirable to leave the non-stick covering or backing on the sealant 62 during the step of installing the seal 60 into the drain lines 120, however this non-stick backing has been removed in the Figures for illustration purposes to clearly illustrate the insertion into the drain lines. The seal 60 as illustrated in FIG. 19 seals to the inner surface 128 upon insertion.

Figure 20:
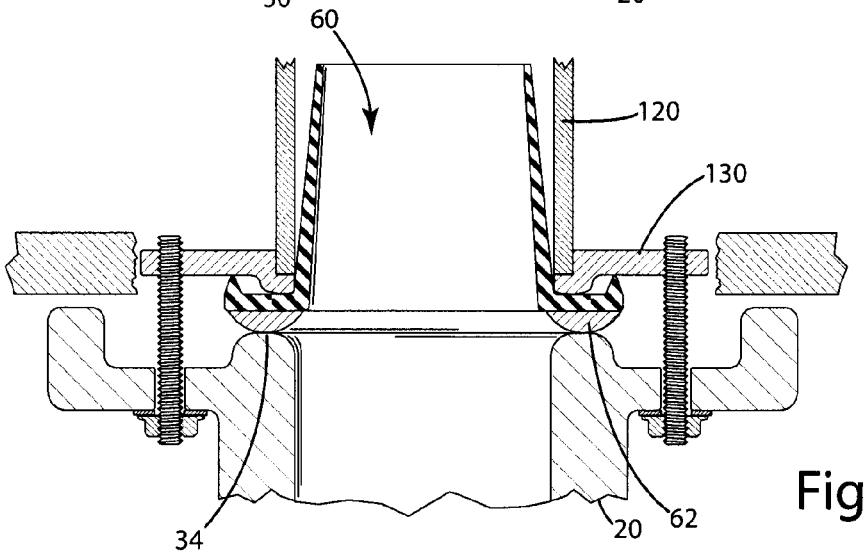
FIG. 20 is a cross-sectional view of the urinal and wall illustrating partial tightening.
Figure 21:
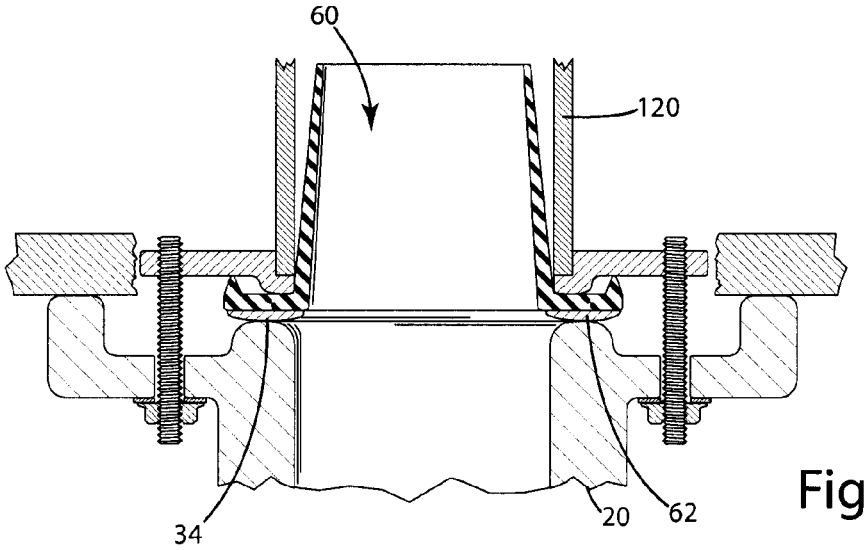
FIG. 21 is a cross-sectional view of the wall and urinal illustrating a final installed position of the urinal seal and urinal relative to the wall adapter.

After the seal 60 is installed or inserted into the wall adapter 130 and/or drain lines 120, the urinal 20 is hung on the mounting brackets 106. Of course, before the urinal 20 can be hung on the mounting brackets 106, the urinal must be prepared. For new urinals, this typically would only require wiping with a clean cloth around the siphon outlet 32, siphon flange 34 and specifically the siphon inner diameter 36. On an existing or reinstallation of a urinal, the urinal must be clean, dry and free from wax or old sealing material on the wall side 40 of the urinal 20 and specifically around the siphon outlet 32, siphon flange 34 and the sealing area 46 on the wall recessed surfaces 34. On an existing urinal, it may also be desirable to clean around the wall surfaces 42 which engage the wall 102 when the urinal 20 is installed upon the wall 102. With the urinal prepared, the top of the urinal is hung on the pivot brackets and then the urinal is pivoted or tilted downward in an arcuate motion until the seal 60 makes contact with the urinal 20. The plumber, if necessary or if space is available, would reach behind the urinal 20 and press the seal firmly into place to ensure that the adhesive has sufficiently engaged the siphon flange 34. Of course, this step can many times be eliminated if the urinal seal 60 was properly installed into the drain lines 120 and the mounting brackets are accurately positioned. With the urinal resting against the seal 60 as illustrated in FIG. 19, the plumber would install the adapter fastener assembly 140. Of course, the threaded screw rods 142 may have already been installed on the adapter wall plate 130. The nuts 144 may then be tightened down further sealing the seal 60 into the drain lines 120 and adapter wall plate 130 as illustrated further in FIG. 20. The plumber would then further tighten the nuts 144 until the wall surfaces 42 on the wall side 40 of the urinal 20 engage the walls 102 at which point the adhesive 62 or sealant has typically been compressed fully against the siphon flange 34 and the adapter sealing flange 136 has fully engaged the adapter sealing surface 86 on the seal portion 80 of the seal 60 as well as the circumferential flange 84 engaging the adapter seal surface 134, as illustrated in FIG. 20. With the urinal 20 installed, the plumber would then check for leaks and verify that the drain connection is leak-free.

One significant advantage of the urinal seal 60 of the present invention as well as the above-described installation process, is that the urinal seal may be loosely placed into the drain line 120 and is held in place by the seal body 64 specifically the frusto-conical shaped pipe insert portion 70 even though the adapter wall plate 130 sits on a vertical wall 102. With the urinal seal 60 being held in place and the adhesive 62 being located on the seal 60 with the pivoting of the urinal in place, numerous steps are removed from the installation process such that the plumber only needs to pivot the urinal down to engage the seal and then tighten the adapter fastener assembly 140 to fully install the urinal 20.

The foregoing discussion discloses and describes an exemplary embodiment of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. A urinal seal comprising:
- a pipe insert portion having a frusto-conical shape;
- a seal portion radially extending outward from said pipe insert portion;
- a circumferential flange extending from said seal portion and substantially uniformly spaced from said pipe insert portion;
- a sealant applied to said seal portion and wherein said sealant is applied to the opposing side of said seal portion from said circumferential flange and wherein said circumferential flange is free of said sealant applied to said seal portion; and
- a circumferential adapter sealing surface located between said pipe insert portion and said circumferential flange.

2. The urinal seal of claim 1 wherein said pipe insert portion includes a wall extending from the seal portion to an end.

3. The urinal seal of claim 2 wherein said walls have a substantially uniform thickness.

4. The urinal seal of claim 2 wherein said walls include a first portion having a substantially uniform thickness and a second portion having a reducing thickness from said first portion to said end.

5. The urinal seal of claim 2 wherein said walls include a first portion having a first thickness and a second portion having a second thickness and wherein said first thickness is different than said second thickness.

6. The urinal seal of claim 1 wherein said circumferential flange has a triangular shaped cross-section.

7. The urinal seal of claim 1 wherein said circumferential flange has a rounded cross-section shape.

8. The urinal seal of claim 1 wherein said circumferential flange has a rectangular cross-sectional shape.

9. The urinal seal of claim 1 wherein said sealing portion includes a first surface and a second surface substantially parallel to the first surface and wherein said sealant is an adhesive is adhered to said first surface and said second surface is said circumferential adapter sealing surface.

10. The urinal seal of claim 1 wherein said pipe insert portion proximate to said sealing portion has an outer diameter of approximately equal to or less than 2 inches.

11. The urinal seal of claim 1 wherein said sealant is an adhesive.

12. The urinal seal of claim 1 wherein said circumferential adapter sealing surface is free of said sealant applied to said seal portion.

13. A urinal seal comprising:
- a pipe insert portion having a frusto-conical shape;
- a seal portion radially extending outward from said pipe insert portion, said pipe insert portion including a wall extending from the seal portion to an end;
- wherein said wall has a thickness that is tapered to a thinner thickness from said portion proximate to said seal portion to said wall proximate to said end;
- a circumferential flange extending from said seal portion and substantially uniformly spaced from said pipe insert portion;
- a sealant applied to the sealing portion and wherein the adhesive is applied to the opposing side of said seal portion from said circumferential flange; and
- a circumferential adapter sealing surface located between said pipe insert portion and said circumferential flange.

14. A urinal seal comprising:
- a pipe insert portion having a frusto-conical shape and wherein said pipe insert portion is approximately equal to or less than two inches at its widest outer diameter;
- a seal portion radially extending circumferentially outwardly form said pipe insert portion and proximate to said widest outer diameter of said pipe insert portion and wherein said seal portion includes a first surface opposed to an adapter sealing surface; and
- a sealant adhered to said seal portion and wherein said sealant is adhered to said first surface, and said adapter sealing surface is free of said sealant.

15. The urinal seal of claim 14 wherein said urinal seal is formed from a material having a durometer hardness of approximately 75.

16. A method of installing a urinal on a vertical wall, the urinal including a siphon outlet and the wall including a drain inlet having an inner drain surface with an inner diameter and a wall adapter having an adapter flange, said method including the steps of:
- providing a urinal seal having a pipe insert portion and a flange extending radially outward from the pipe insert portion and a sealant;
- inserting the urinal seal partially into the drain inlet until the pipe insert portion sealingly engages the inner drain surface;
- mounting the urinal to the vertical wall with the siphon outlet engaging the flange of the urinal seal; and
- fastening the urinal to the wall to compress the flange between the siphon outlet and the drain inlet, and the wall adapter to create at least three watertight seals including:
  - a first water tight seal between an outer surface of the pipe insert portion and the inner drain surface, creating a second water tight seal between the siphon outlet and the flange of the urinal seal and creating a third water tight seal between the adapter flange and the flange of the urinal seal.

17. The method of claim 16 wherein said radially extending flange further includes a circumferential flange and wherein said method further includes the step of creating a fourth seal between the adapter and the circumferential flange.

18. The method of claim 16 wherein said radial flange includes a sealant material and wherein said step of fastening the urinal includes the step of compressing the sealant material.

19. The method of claim 18 wherein said step of compressing the sealant material includes the step of adhering the siphon outlet to the radial flange with the sealant material.

20. The method of claim 16 wherein said step of mounting the urinal further includes the steps of:

mounting an upper portion of the urinal to the vertical wall; and tilting a lower portion of the urinal in an arcuate motion toward the vertical wall until the siphon outlet engages the radial flange of the urinal seal.

21. A urinal seal configured to provide a water tight seal between a urinal and at least one of a pipe and a wall adapter plate coupled to said pipe, said urinal seal comprising:

a pipe insert portion having a frusto-conical shape;

a seal portion radially extending outwardly from said pipe insert portion to an outer diameter and having a first surface and an opposing second surface;

a circumferential flange extending from said seal portion on said second surface and configured to directly engage the wall adapter plate;

a sealant applied to said first surface of said second portion and configured to adhere to the urinal; and a circumferential adapter sealing surface located between said pipe insert portion and said circumferential flange and wherein said circumferential adapter sealing surface is configured to directly engage at least one of the wall adapter plate and the pipe.

* * * * *